US011040239B2

(12) United States Patent
Hilderbrandt et al.

(10) Patent No.: US 11,040,239 B2
(45) Date of Patent: Jun. 22, 2021

(54) SMART TRAINER

(71) Applicant: Sollos LLC, Saline, MI (US)

(72) Inventors: Mark D. Hilderbrandt, Saline, MI (US); Daniel Koester, Ann Arbor, MI (US)

(73) Assignee: SOLLOS LLC, Saline, MI (US)

( * ) Notice: Subject to any disclaimer, the term of this patent is extended or adjusted under 35 U.S.C. 154(b) by 124 days.

(21) Appl. No.: 16/493,015

(22) PCT Filed: Mar. 14, 2018

(86) PCT No.: PCT/US2018/022483

§ 371 (c)(1),
(2) Date: Sep. 11, 2019

(87) PCT Pub. No.: WO2018/170161

PCT Pub. Date: Sep. 20, 2018

(65) Prior Publication Data

US 2020/0061410 A1 Feb. 27, 2020

Related U.S. Application Data

(60) Provisional application No. 62/471,026, filed on Mar. 14, 2017.

(51) Int. Cl.
*A63B 22/20* (2006.01)
*A63B 21/00* (2006.01)
(Continued)

(52) U.S. Cl.
CPC ..... *A63B 22/203* (2013.01); *A63B 21/0051* (2013.01); *A63B 21/00069* (2013.01); *A63B 21/22* (2013.01); *A63B 2208/0233* (2013.01)

(58) Field of Classification Search
CPC ..... A63B 21/00058; A63B 21/00069; A63B 21/00076; A63B 21/00192; A63B 21/005;
(Continued)

(56) References Cited

U.S. PATENT DOCUMENTS 3,372,930 A * 3/1968 Sertich ..... A63B 22/14 473/452
4,618,139 A 10/1986 Haaheim
(Continued)

OTHER PUBLICATIONS

International Search Report for PCT/US2018/022483, dated Jun. 6, 2018, 2 pgs.

*Primary Examiner* — Gary D Urbiel Goldner
(74) *Attorney, Agent, or Firm* — Dickinson Wright PLLC

(57) ABSTRACT

An exercise device includes a base, a first platform and a second platform. Both platforms move between a forward position and a rearward position along each own path relative to the base. The exercise device includes a flexible member operatively coupled with the first and second platforms. Furthermore, a resistance mechanism is coupled with the flexible member and configured to resist movement of at least one of the first platform and the second platform. The resistance mechanism includes a disc positioned parallel to the base and is configured to allow the disc to rotate relative to a vertical axis of the base. In addition, the flexible member is configured to allow the disc to rotate reciprocally in response to movement of the first platform or second platform.

10 Claims, 11 Drawing Sheets

(51) Int. Cl.
*A63B 21/005* (2006.01)
*A63B 21/22* (2006.01)

(58) Field of Classification Search
CPC ..... A63B 21/0051; A63B 21/0052; A63B 21/0056; A63B 21/0057; A63B 21/012; A63B 21/015; A63B 21/018; A63B 21/04; A63B 21/0407; A63B 21/0414; A63B 21/0421; A63B 21/0428; A63B 21/0435; A63B 21/0442; A63B 21/055; A63B 21/0552; A63B 21/0555; A63B 21/0557; A63B 21/15; A63B 21/151; A63B 21/157; A63B 21/22; A63B 21/225; A63B 21/227; A63B 21/4027; A63B 21/4033; A63B 21/4034; A63B 21/4045; A63B 22/0046; A63B 22/20; A63B 22/201; A63B 22/203; A63B 69/0022; A63B 69/182; A63B 71/0054; A63B 2071/0072; A63B 2209/08; A63B 2225/09
See application file for complete search history.

(56) References Cited

U.S. PATENT DOCUMENTS 4,709,918 A * 12/1987 Grinblat ..... A63B 21/012 482/118
5,108,093 A * 4/1992 Watterson ..... A63B 22/0012 482/112
5,145,481 A * 9/1992 Friedebach ..... A63B 21/015 482/118
5,279,531 A 1/1994 Jen-Huey
5,299,996 A * 4/1994 Chi ..... A63B 21/018 482/51
5,338,273 A 8/1994 Metcalf et al.
5,368,533 A * 11/1994 Feuer ..... A63B 21/154 482/134
5,407,409 A * 4/1995 Tang ..... A63B 21/018 482/118
5,417,630 A 5/1995 Schultz
5,499,957 A * 3/1996 Metcalf ..... A63B 22/0012 482/51
5,514,053 A * 5/1996 Hawkins ..... A63B 21/15 482/63
5,575,740 A * 11/1996 Piaget ..... A63B 22/0012 482/51
5,807,212 A * 9/1998 Nelson ..... A47C 7/62 482/60
5,833,584 A * 11/1998 Piaget ..... A63B 21/4047 482/70
5,848,953 A * 12/1998 Wei ..... A63B 21/0051 482/63
5,989,163 A 11/1999 Rodgers, Jr.
7,648,447 B2 * 1/2010 Andre ..... A63B 23/0417 482/60
7,785,236 B1 * 8/2010 Lo ..... A63B 21/0051 482/63
8,075,426 B1 * 12/2011 Griffin ..... A63B 69/0002 473/452
8,202,205 B2 6/2012 Reade
8,957,641 B1 * 2/2015 Hsu ..... A63B 24/0087 322/4
9,278,251 B2 * 3/2016 Decca ..... A63B 22/0694
9,283,428 B1 * 3/2016 Esrick ..... A63B 21/00069
9,301,618 B2 * 4/2016 Leonhard ..... A47C 7/006
9,616,283 B1 4/2017 Heineck et al.
2002/0151415 A1 * 10/2002 Hildebrandt ..... A63B 21/157 482/57
2004/0204293 A1 * 10/2004 Andreasen ..... A63B 21/00181 482/52
2011/0105277 A1 5/2011 Shauli
2014/0031175 A1 * 1/2014 Peralo ..... A63B 23/0244 482/66
2014/0191552 A1 * 7/2014 Weber ..... A63B 22/001 297/344.21
2015/0182773 A1 7/2015 Olson et al.
2016/0028298 A1 * 1/2016 Lo ..... A63B 21/225 482/63
2016/0263415 A1 * 9/2016 Chen ..... H02K 49/043
2016/0296791 A1 10/2016 Bailar
2016/0325137 A1 11/2016 Bailar
2017/0113094 A1 4/2017 Bailar

* cited by examiner

SMART TRAINER

CROSS-REFERENCE TO RELATED APPLICATION

This application claims priority to and the benefit of PCT/US2018/022483, filed Mar. 14, 2018 and U.S. Provisional Application No. 62/471,026, which was filed Mar. 14, 2017, and is incorporated by reference in its entirety.

TECHNICAL FIELD

The present disclosure relates generally to a personal exercise apparatus. More specifically the present disclosure is directed to a device that provides for exercise of the body from a seated position.

BACKGROUND

This statements in this section merely provide background information related to the present disclosure and may not constitute prior art. Exercise equipment for individual training, conditioning and rehabilitation has a long history of development. There have been many proposed machines for simulating physical activities such as running, cycling and skiing or otherwise providing a means for exercising on a stationary apparatus, both for fitness and rehabilitation purposes. Correspondingly, there have been proposed systems for integrating computer technology to these machines for improved exercise programming and performing tracking.

Recent research has suggested that moderate exercise throughout the day can provide additional benefits over exercising at an exercise/rehabilitation facility or other forms of dedicated physical activity. In order to address the health concerns presented by the modern sedentary lifestyle, there have been proposed apparatuses for improving the ease and effectiveness of increased exercise throughout a busy workday. For example, people spend a lot of time sitting in front of computer-terminals, sitting in libraries and classrooms, and sitting in front of television without doing any type of physical exercise to stimulate their muscles. It is recognized that the best activities for the heart are those that use the large muscles of the body, particularly those in the legs, making them demand more oxygen to do their work. The activities that involve repetitive motion of an extended period of time are effective for cardiovascular health. Thus, if people can easily exercise while they are seated, people can have the benefits of seated exercise without the negative effects.

In addition, the exercise equipment can be used for physiotherapy purpose. For example, certain patients who had total knee replacement, surgical or traumatic injury rehabilitation and others can perform exercising while in a seated position without transferring the patients to the exercise equipment from a wheelchair or other aid device for their safety. Accordingly, the seated exercise benefits tie into ease of use and more enjoyment without any loss of physiological benefits.

The above information disclosed in this Background section is only for enhancement of understanding of the background of the present disclosure and therefore it may contain information that does not form the prior art that is already known to a person of ordinary skill in the art.

SUMMARY

The present disclosure relates to an exercise device for providing the exercise or rehabilitation of the body in a seated position. According to one aspect of the present disclosure, the exercise device includes a base, a first platform configured to move between a forward position and a rearward position along a first path relative to the base, and a second platform configured to move between the forward position and the rearward position along a second path relative to the base. The exercise device further includes a flexible member operatively coupled with the first platform and the second platform, and a resistance mechanism coupled with the flexible member and configured to resist movement of at least one of the first platform or the second platform. The resistance mechanism includes a disc positioned parallel to a plane of the base. Also, the resistance mechanism is configured to allow the disc to rotate relative to a vertical axis of the plane of the base in a first direction as the first platform moves from the rearward position to the forward position and a second direction opposite the first direction as the first platform moves from the forward position to the rearward position. In addition, the flexible member is configured to allow the disc to rotate reciprocally in response to movement of the first platform or the second platform.

The resistance mechanism further includes magnets configured to resist movement of the first platform or the second platform by a magnetic resistance force between the disc and the magnets. In addition, the resistance mechanism includes an adjuster operatively coupled with the magnets and moved in parallel to the plane of the base for providing variable resistance to movement of the first platform or the second platform. Furthermore, the adjuster is substantially placed between the first platform and the second platform, and moves in a longitudinal direction relative to the base. The variable resistance forces are adjusted by an engagement area between the disc and the magnets.

The first direction above is a counter clockwise (CCW) rotation and the second direction is clockwise (CW) rotation. The first path and second path above is a linear path. The base includes an upper panel and a lower panel. The upper panel includes a first and second outer rail, and a first and second inner upper rail. The lower panel includes a first and second inner lower rail. In addition, inner and outer roller wheels are respectively mounted under the first platform and the second platform, and are configured for pairing with the inner and outer rails. Each of the inner upper and lower rails is C-shape and is configured to prevent lateral movement of the first and second platforms. Each of the outer rails is a flat shape.

The flexible member is an elastic member for maintaining a tension. The flexible member can be a timing belt or poly-v belt. The first and second platforms are respectively connected with the flexible member by a first and a second attachment bracket. In addition, the flexible member moves about a first rotational axis and a second rotational axis to couple with movement of the first platform and the second platform. The first rotational axis is coaxially connected with the disc and the second rotational axis is rearwardly located at a certain distance from the first rotational axis. The first and second rotational axis are substantially positioned between the first platform and the second platform.

A removable foot strap is installed to each of the first platform and the second platform and configured to secure user's foot to each platform. Furthermore, the exercise device comprises a resistance band coupled with the base and the resistance band is configured for exercising an upper body of the user.

According to another aspect of the present disclosure, a secondary linear glide is attached to each of the first and second platforms and engaged with the first and second outer rails. In addition, the second linear glide engaged with the outer rail is configured for preventing the outer roller wheels from lifting off.

According to another aspect of the present disclosure, the exercise device includes a base, a first platform configured to move between a forward position and a rearward position along a first path relative to the base, and a second platform configured to move between the forward position and the rearward position along a second path relative to the base. The exercise device further includes a flexible member operatively coupled with the first platform and the second platform, and a resistance mechanism coupled with the flexible member and configured to resist movement of at least one of the first platform or the second platform. The resistance mechanism includes a first and second discs positioned parallel to a plane of the base. Also, the resistance mechanism is configured to allow the discs to rotate relative to a vertical axis of the plane of the base. The first disc rotates in a first direction as the first platform moves from the rearward position to the forward position, and keeps rotating in the first direction. The second disc rotates in a second direction opposite the first direction as the first platform moves from the forward position to the rearward position, and keeps rotating in the second direction. In addition, the flexible member is configured to allow the first and second discs to rotate in response to movement of the first platform or the second platform.

In addition, the exercise device further includes a one-way clutching system. The one-way clutching system is respectively connected with the first and second discs, and is configured for allowing each disc to be linked only with the flexible member when the flexible member is moving in the same direction as each disc's rotational direction.

The flexible members moves about a first rotational axis and a second rotational axis to couple with movement of the first platform and the second platform. The first disc is coaxially connected with the first rotational axis and the second disc is coaxially connected with the second rotational axis. In addition, the first disc is in the forward position and the second disc is in the rearward position along a longitudinal axis of the base. Also, the resistance mechanism includes first magnets and second magnets. The first and second magnets are configured to resist movement of the first platform or second platform by adjusting an engagement area between each disc and magnets.

According to another aspect of the present disclosure, the exercise device includes a base, a first platform configured to move between a forward position and a rearward position along a first path relative to the base, and a second platform configured to move between the forward position and the rearward position along a second path relative to the base. The base includes a cutout at rear end of the base. The exercise device includes a flexible member. The flexible member is substantially placed between the first platform and the second platform, and configured for moving about a first rotational axis and a second rotational axis to couple with movement of the first platform and the second platform. A resistance mechanism is coupled with the flexible member and configured to resist movement of at least one of the first platform or the second platform. The resistance mechanism further includes a disc positioned parallel to a plane of the base. The flexible member is configured to allow the disc to rotate reciprocally in response to movement of the first platform or second platform. Furthermore, the cutout of the base is forwardly located in a certain distance from a rearmost position of the first or second platform.

The cutout of the base is also located at center location of the base and substantially positioned between the first platform and the second platform. The cutout of the base is configured to receive a caster of a chair, and to prevent the casters of the chair from interfering with the exercise device. The cutout of the base includes a generally vertical wall around the cutout. Specifically, the cutout of the base includes a first vertical wall and a second vertical wall opposite the first vertical wall.

A first attachment bracket of the first platform and a second attachment bracket of the second platform for coupling with the flexible member are offset forward of a midpoint of each of the first and second platforms.

Further areas of applicability will become apparent from the description provided herein. Everyone should understand that the description and specific examples presented herein are for the purpose of illustration only and are not intended to limit the scope of the present disclosure.

BRIEF DESCRIPTION OF THE DRAWINGS

In order that the disclosure may be well understood, there will now be described various forms thereof, given by way of example, reference being made to the accompanying drawings, in which.

Figure 1A:
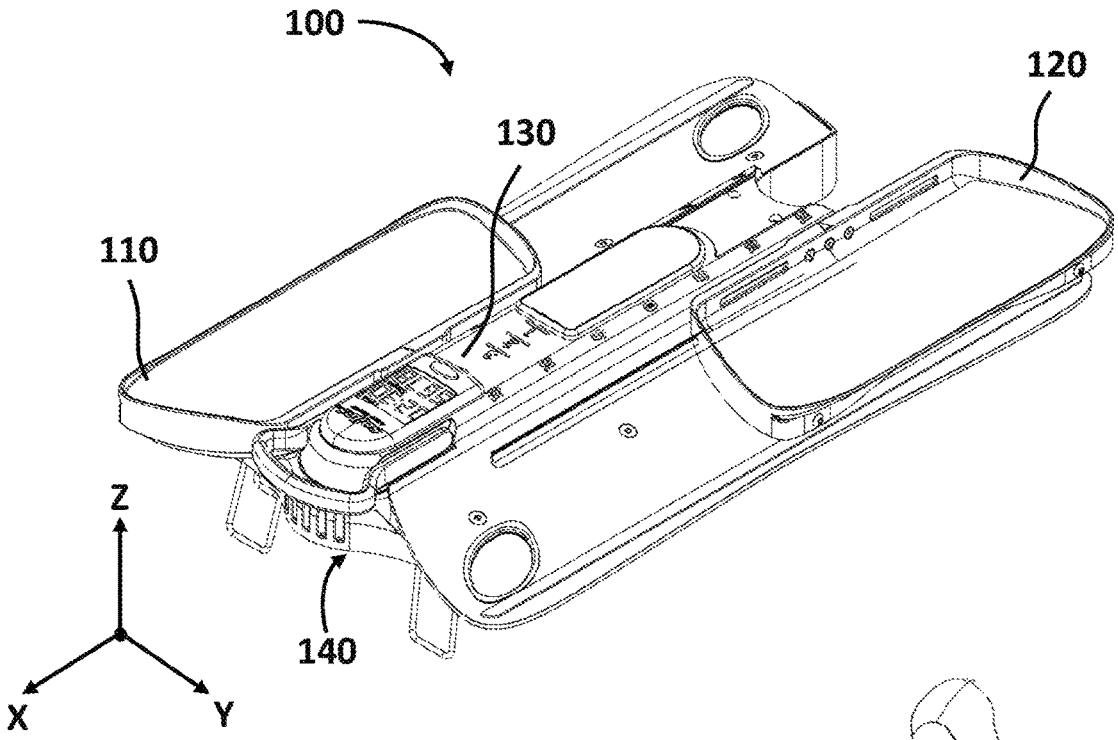
FIG. 1A is a perspective view of the exercise device.

The drawings described herein are for illustration purposes only and are not intended to limit the scope of the present disclosure in any way.

DETAILED DESCRIPTION

The following description is merely exemplary in nature and is in no way intended to limit the present disclosure or its application or uses. It should be understood that throughout the drawings, corresponding reference numerals indicate like or corresponding parts and features.

FIG. 1A is an illustration of an exercise device 100 according to an exemplary form of the present disclosure. The exercise device 100 includes a first platform 110 and a second platform 120 for placing a user's feet. The exercise device 100 further includes a top cover 130 and a base 140. The exercise device 100 may be used for exercising while seated on a chair or rehabilitating a patient's lower body in a clinic or at home.

Figure 1B:
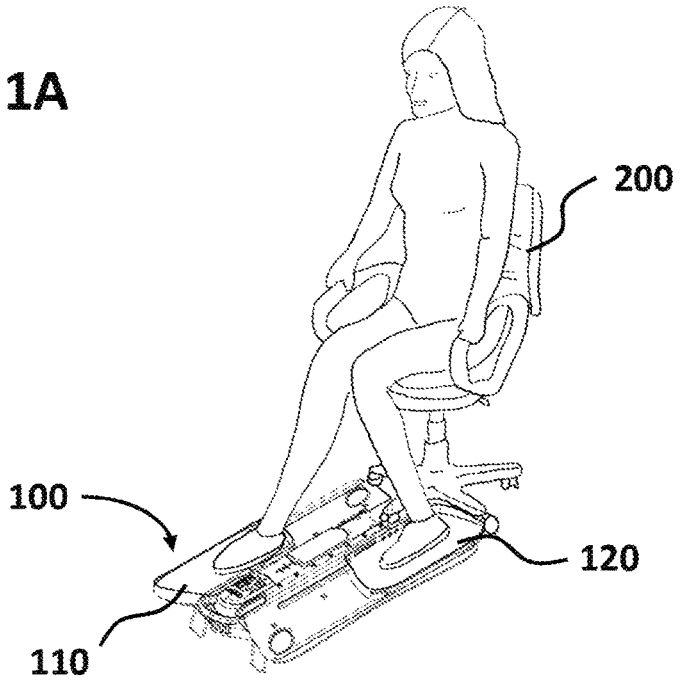
FIG. 1B illustrates the exercise device shown in use.

FIG. 1B, as an example, shows a user sitting on an office chair 200 while ready to exercise his/her lower body by placing his/her feet on the first platform 110 and the second platform 120. The exercise device 100 enables optimal access from a seated position using typical types of chairs including the office chairs, narrow wheelchairs, regular-sized wheelchairs, folding and non-folding chairs, and walkers/rollators, etc. The exercise device 100, which rests on the floor, has a narrow width dimension of ~13 inch such that the exercise device 100 can rest between typical chair legs, casters, or wheels of a wheelchair, to enable the user to achieve an optimal ergonomic seated starting position relative to the exercise device 100—a 90 degree knee, a 90 degree hip, and a 90 degree ankle angle to start. From this starting position, the user may then move the chair farther or closer away from the exercise device 100 and continue the reciprocating back and forth movement and which varies the exercise, feeling, conditioning and rehabilitation such as joint kinematics of the user's body.

For example, in early-stage post knee replacement surgery, the rehabilitation therapy goal is to extend/straighten the leg and chair is farther rearward from the exercise device 100. In later stage knee replacement rehabilitation, the goal is for maximum knee flexion and the chair is moved closer over the exercise device 100.

Furthermore, the exercise device 100 can be specifically used for enabling deconditioned people, for example, an elderly person confined to a wheelchair or a debilitated person due to surgery, illness or prolonged immobility, to easily access and achieve the benefits of resistive endurance training. The exercise device 100 can be also used by more physically abled users, but who suffer from the health effects of prolonged sitting at desk for long period of time.

Similarly, as a travel version, a smaller version of the exercise device 100 may be used. The travel version of the exercise device 100 is a small, simplified, lightweight and portable version which can be used during traveling. The travel version of the exercise device 100 can be used in various forms of transportation like in an automobile, plane, train and bus, etc., in which the user is required to be in a seated position for long period of time, and where space due to mass transit seating is limited. The travel version can be also used in classrooms or in other facilities, where space is also limited.

Figure 2:
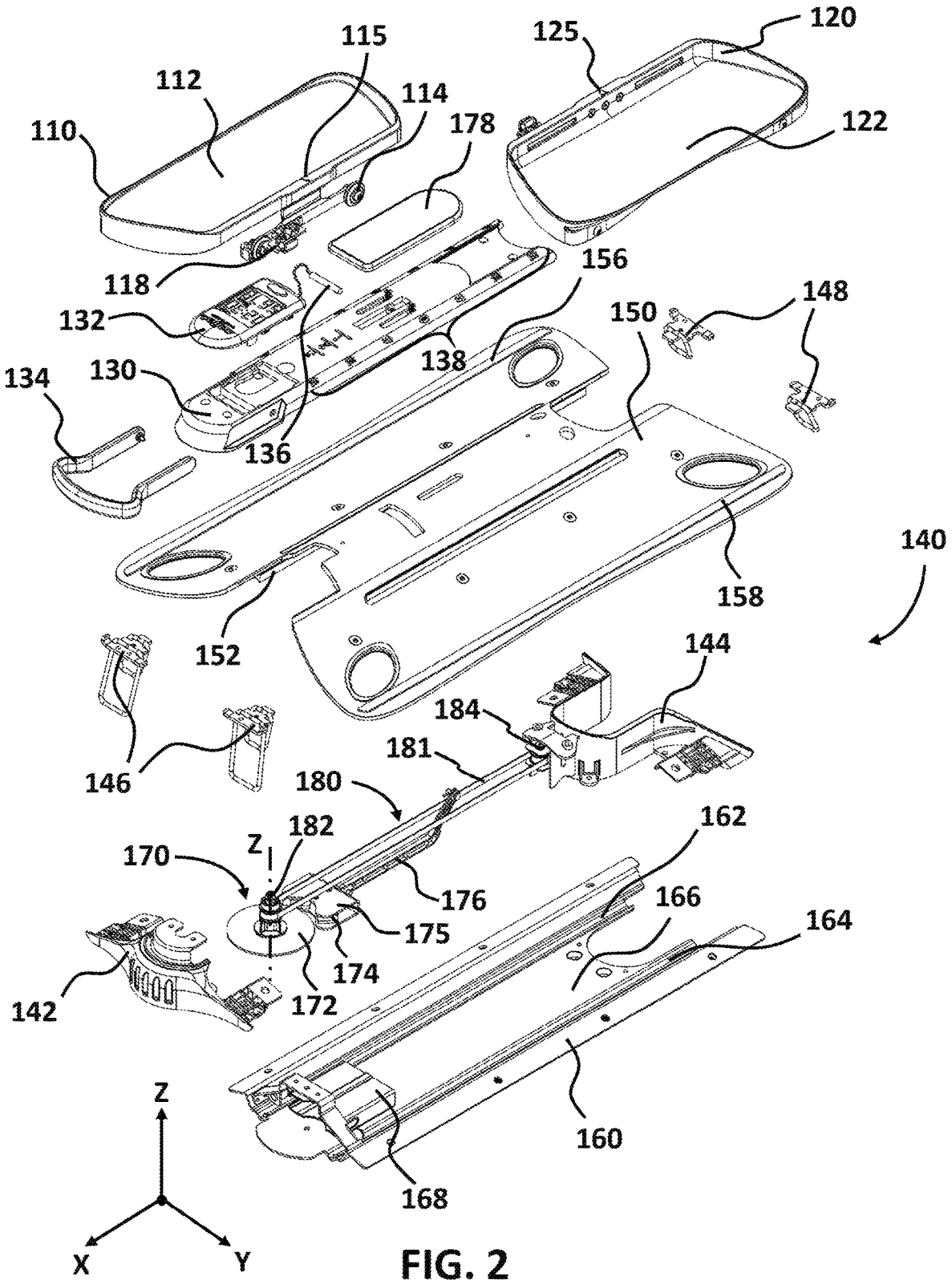
FIG. 2 is an exploded view of the exercise device.

FIG. 2 shows an exploded view of the exercise device 100. Each of the first platform 110 and the second platform 120 includes inner roller wheels 114, 124 and outer roller wheels 116, 126 (see FIG. 7A) that will be described in detail later. Furthermore, planes 112, 122 on each of the first platform 110 and the second platform 120 is defined as parallel planes to the floor where the exercise device 100 is placed. Each of the planes 112, 122 is configured for receiving the user's foot while the user is exercising in a seated position as shown in FIG. 1B.

In accordance with an exemplary form of the present disclosure, the base's 140 angle or height relative to the floor may be adjusted by utilizing a front kick stand 146 or a rear kick stand 148 attached to an upper panel 150 of the base 140. However, other suitable height or angle adjustment mechanisms may be implemented in order to raise or angle the front or rear side of the exercise device 100. Accordingly, the user can exercise or rehabilitate in various conditions by utilizing the front or rear kick stand 146, 148 attached to the upper panel 150, while he/she is exercising in a seated position. In particular, the angled position of the exercise device 100 could help facilitating improved knee extension therapy.

In FIG. 2, the top cover 130 includes a visual display 132 and a carrier handle 134. In accordance with an exemplary form of the present disclosure, the visual display 132 includes a cadence sensor 136 for providing the user workout feedback and Bluetooth capability displays workout data on paired smart devices. Accordingly, the user can easily track his/her workout data for achieving or motivating the his/her goal by the visual display 132 or the paired smart devices. The carrier handle 134 may be centrally positioned and attached to the top cover 130 such that the user may conveniently carry, move, place and adjust the exercise device 100. Furthermore, an adjuster 178 may be installed on the surface of the top cover 130, which may be placed on the center of the base 140. In accordance with an exemplary form of the present disclosure, as shown in FIG. 1A, the adjuster 178 may be substantially placed between the first platform 110 and the second platform 120, and is configured for easily adjusting a resistance of a mechanism 170 by the user. In addition, measuring scales 138 may be added on top surface along a longitudinal direction of the top cover as shown in FIG. 2. While rehabilitating the body of the user, the measuring scales 138 may be configured for controlling the movement of the user's foot. For example, after knee replacement surgery, the movement of the user's foot for rehabilitating the knee may be controlled inch-by-inch movement by the measuring scales 138.

The resistance mechanism 170 includes a disc 172, magnets 174 attached to a magnet bracket 175, an adjuster arm 176 and the adjuster 178, and may be configured to operatively couple with a flexible member 181. A coupling mechanism 180 includes the flexible member 181, a first rotational axis 182 and a second rotational axis 184, and may be operatively coupled with the first and second platforms 110, 120. The resistance mechanism 170 may be configured to provide the resistance effect on the coupling mechanism 180 by absorbing an energy transferred from the coupling mechanism 180. The coupling mechanism 180 may be configured to move at least one of the first platform 110 or the second platform 120 in a coordinated and reciprocal manner.

The base 140 includes the upper panel 150, a lower panel 160, a front cover 142, and a rear cover 144. The upper panel 150 and the lower panel 160 are connected each other, and the front and rear cover 142, 144 are attached to the upper and lower panel 150, 160. In accordance with an exemplary form of the present disclosure, the resistance and coupling mechanisms 170, 180 may be placed at center location of the base 140 and substantially between the first platform 110 and the second platform 120. In addition, the resistance mechanism 170 other than the adjuster 178 may be placed between the upper panel 150 and the lower panel 160. Preferably, the upper panel 150 and the lower panel 160 may be formed from a plastic, steel, wood or any suitable materials that can support the movement of the first platform 110 and the second platform 120.

As shown in FIG. 2, the upper panel 150 includes a first and second inner upper rail 152, 154 on the bottom surface of the upper panel 150 (shown in FIG. 7A), and a first and second outer rail 156, 158 on the top surface of the upper panel 150. The lower panel 160 includes a first and second inner lower rail 162, 164. The inner upper and lower rails 152, 154, 162, 164 are engaged with the inner roller wheels 114, 124 (shown in FIG. 7A) and the first and second outer rails 156, 158 are engaged with the outer roller wheels 116, 126 for movement of the first platform 110 and the second platform 120. The lower panel 160 further includes a magnet installation guide 168 configured for securing the magnet bracket 175 with the magnets 174 when they are assembled.

FIGS. 3A-3D are perspective views of the exercise device 100 without the top cover 130 and the middle portion of the upper panel 150 for illustrating the internal arrangement of the base 140. The exercise device 100 is configured to reciprocate the first and second platforms 110, 120 translated fore and aft by the user who determines a range of certain movement motion—for example, the movement motion ranging between 2" and 18" or more or less. The user may control the amount of foot movement fore and aft, and can vary the distance at will.

The reciprocating movement of the first and second platforms 110, 120 can be transferred via the coupling mechanism 180. In accordance with an exemplary form of the present disclosure, the coupling mechanism 180 may be configured to allow the disc 172 to rotate in a first rotational direction A (Counter Clockwise, CCVV) as the first platform 110 moves from the rearward position to the forward position and a second rotational direction B (Clockwise, CW) opposite the first direction A as the first platform 110 moves from the forward position to the rearward position. For example, as shown in FIG. 3B, by pushing forward on the first platform 110, the second platform 120 translates rearward the same distance via the coupling mechanism 180.

The first platform 110 moves along a first path C, and the second platform 120 moves along a second path D. Both paths C, D may be a linear path parallel to the base 140. However, other suitable paths such as a curved path parallel to the base 140 may be implemented. In addition, when an angle of the base 140 relative to the floor is adjusted by the front or rear kick stand 146, 148, the both paths C, D may be also angled according to the angled base 140.

As described above, having the reciprocating first and second platform movement, enables the user to best control and work an affected side (e.g., after knee replacement), by pushing and challenging the affected side with the unaffected side of the body. The movement itself is smooth, quiet and linear, emulating the gait of the lower leg extremities while walking. Accordingly, as stated above, the coupling mechanism 180 may be configured to provide for the coordinated reciprocal movement of the first and second platforms 110, 120. In addition, the resistance mechanism 170 may be configured for absorbing the energy transferred from the movement of the first or second platform 110, 120 by the coupling mechanism 180. This reciprocating movement in the coupling mechanism 180 can be resisted by the resistance mechanism 170 including the magnets 174 to provide additional, progressive and measurable resistance to the user for endurance, flexibility, balance and strength improvement.

FIGS. 4A-4G are side and perspective views of the resistance mechanism 170 including the magnets 174. As illustrated above, the resistance mechanism 170 includes the disc 172, the magnets 174, the magnet bracket 175, the adjuster arm 176, and the adjuster 178. The resistance mechanism 170 is configured to resist the reciprocating movement of the first platform 110 or the second platform 120 by a magnetic resistance force between the disc 172 and the magnets 174. Generally, as shown in FIGS. 4A-4G, magnetic flux lines interacting with the disc 172 may be controlled by the positioning of the magnets 174 relative to the disc 172.

Figure 4A:
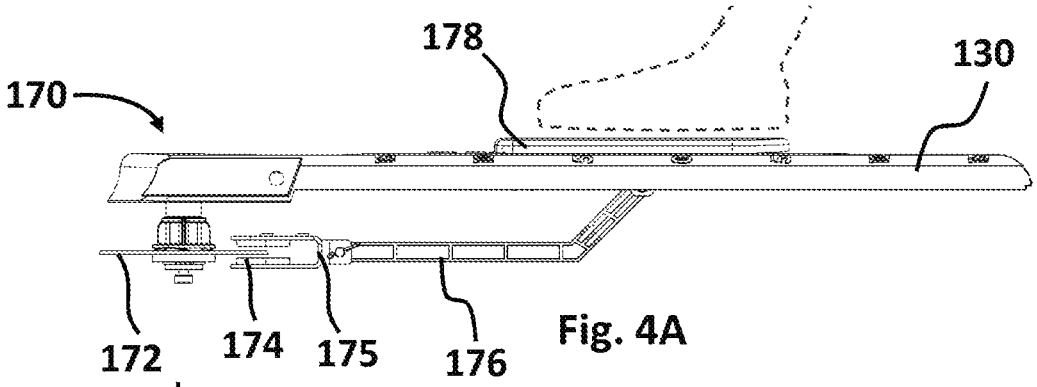
FIG. 4A is a side view of an adjuster being controlled by user's foot.
Figure 4B:
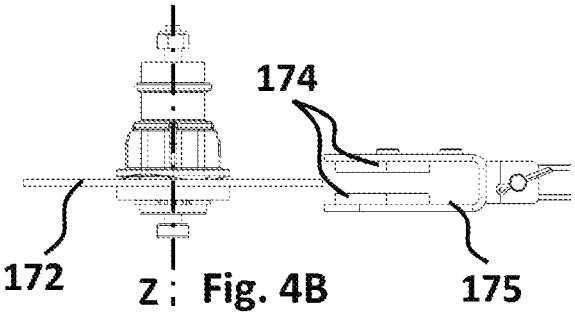
FIGS. 4B-4C are a side and a perspective view of resistance mechanism with lowest resistance force (F1)
Figure 4C:
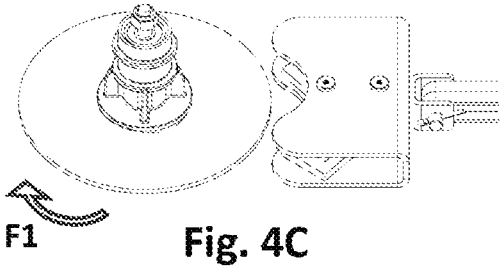
Figure 4D:
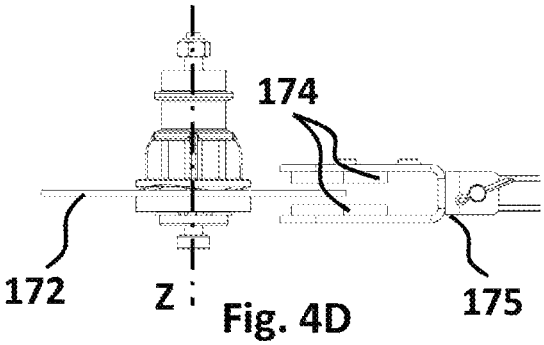
FIGS. 4D-4E are a side and a perspective view of resistance mechanism set at a relative medium resistance force (F2)
Figure 4E:
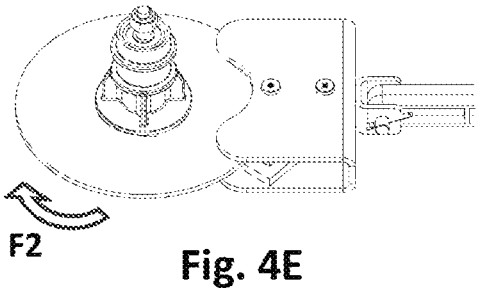
Figure 4F:
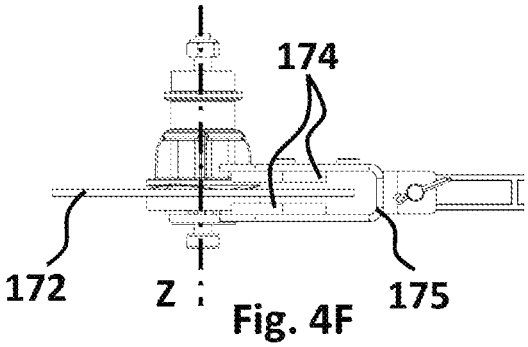
FIGS. 4F-4G are a side and a perspective view of resistance mechanism with set at a relative high resistance force (F3)
Figure 4G:
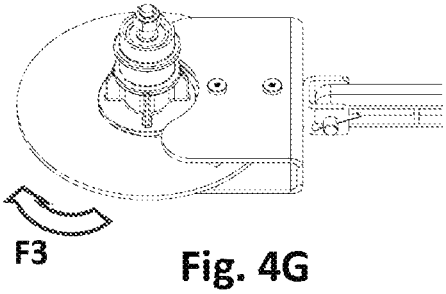

In accordance with an exemplary form of the present disclosure, as shown in FIG. 4A, the magnets 174 may be engaged with both surfaces of the disc 172 because the magnets 174 are attached to the magnet bracket 175 with a yoke shape. Accordingly, the resistance between the disc 172 and the magnets 174 can be adjusted by an engagement area between them. However, other suitable shapes of the magnet bracket 175 according to other resistance mechanism arrangements may be implemented. Thus, in other forms of the present disclosure, the resistance may be adjusted by variable distance between a disc and magnets.

The magnetic resistance force can be adjusted by the user for providing the resistance to the movement of the first and second platforms 110, 120. Accodingly, the ranges of the magnetic resistance force may be varied. As shown in FIG. 4A, the user simply pushes or pull the adjuster 178 connected by the adjuster arm 176 with his/her foot to control the movement resistance applied by the magnets 174. The adjuster 178 may be configured for moving in a longitudinal direction X relative to the base 140 (see also FIG. 1A). For precise magnet settings and resistance, several detents or tactile positions provide repeatable positions with locational feedback from numerical indicators. In addition, the user does not have to bend over from his/her seated position to adjust the movement resistance. Instead, the user may use his/her foot for controlling the adjuster 178. Accordingly, the deconditioned and debilitated people can easily use the exercise device 100.

As an example, FIGS. 4B-4G show the three different relative magnetic resistance forces, F1, F2, and F3 according to the engagement area between the disc 172 and the magnets 174. In accordance with an exemplary form of the present disclosure, the magnetic resistance force F1 provides a lowest resistance (less engaged), the magnetic resistance force F2 provides a medium resistance between the magnetic resistance forces F1 and F3, and the magnetic resistance force F3 provides a highest resistance (fully engaged).

Figure 5A:
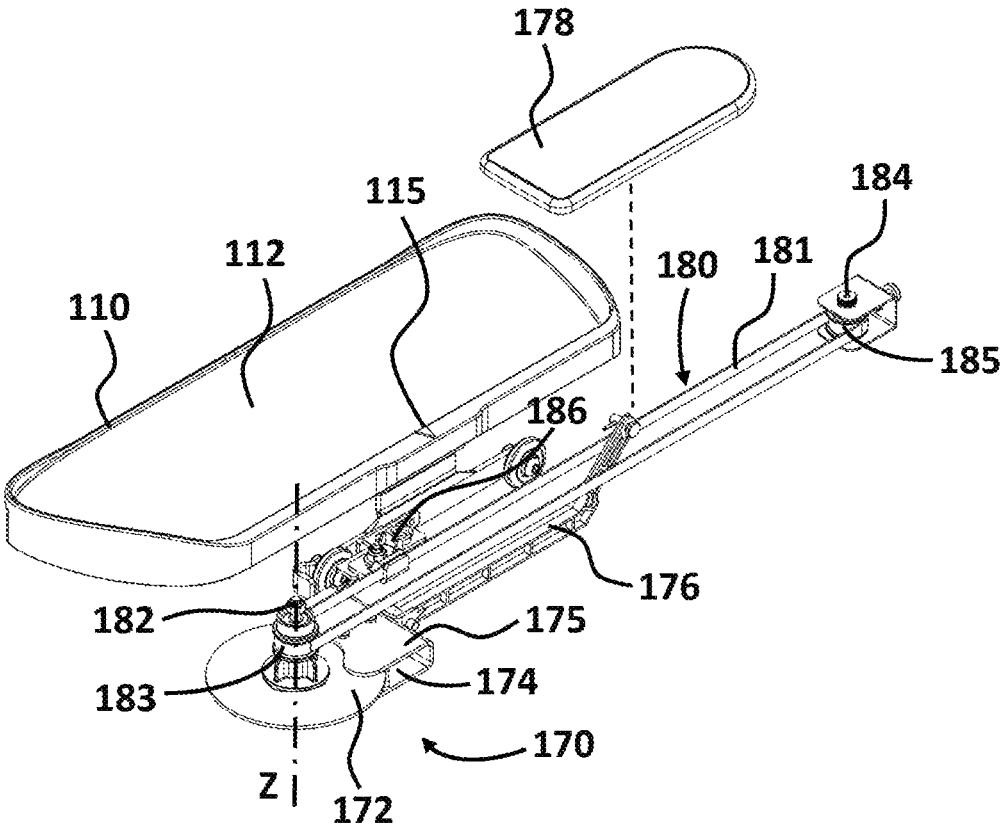
FIG. 5A is an exploded view of resistance and coupling mechanisms.

FIG. 5A illustrates the resistance mechanism 170 and the coupling mechanism 180. As described above, the coupling mechanism 180 including the flexible member 181 may be operatively coupled with the resistance mechanism 170 for transferring the energy by the reciprocal movement of the first and second platforms 110, 120. The flexible member 181 may be also operatively coupled with the first platform 110 and the second platform 120 (See FIG. 3B). FIG. 5A shows only the first platform 110 coupled with the flexible member 181 for better illustration. The flexible member 181 may be configured to allow the disc 172 to rotate reciprocally in response to movement of the first platform 110 or the second platform 120 as described above. In accordance with an exemplary form of the present disclosure, the flexible member 181 can be a timing belt or a poly-v belt for maintaining a tension of the flexible member 181. However, other suitable flexible members such as a chain, a band or a strap, etc. may be used in other forms. The flexible member 181 can be made of a soft material to enable smooth and quiet operation on a first rotational axis 182 and a second rotational axis 184.

Figure 5B:
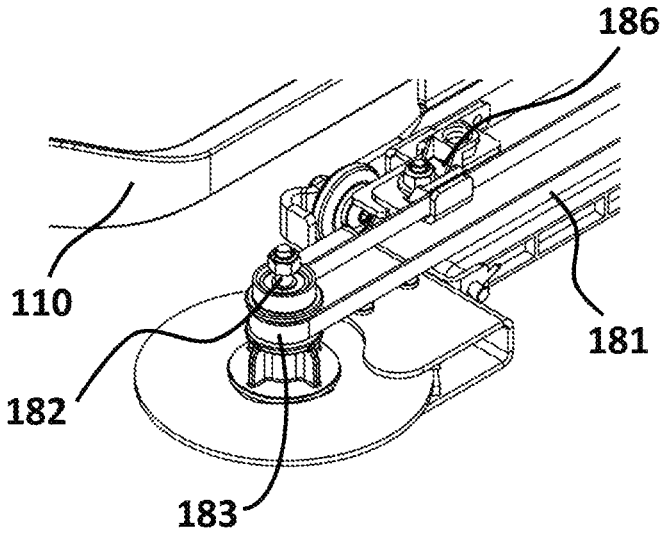
FIG. 5B is a detail view of both mechanisms corresponding FIG. 5A.

In the coupling mechanism 180, the flexible member 181 moves about the first rotational axis 182 and the second rotational axis 184 to couple with movement of the first platform 110 and the second platform 120 (See FIG. 3B). For example, as shown in FIG. 5A, the first and second rotational axis 182, 184 can be a pulley arrangement. The flexible member 181 may move about a first pulley 183 coaxially attached to the disc 172 and a second pulley 185 located rearwardly from the first pulley 183. Accordingly, the first pulley 183 may be configured for driving the disc 172 and the second pulley 185 may be rotated as an idler pulley. As shown in FIG. 5B, the first platform 110 may be connected with the flexible member 181 by a first attachment bracket 186. As such, the second platform 120 may be also connected with the flexible member 181 by a second attachment bracket 188 (not shown in FIG. 5A due to the same configuration as the first platform 110, see FIG. 3B). However, in other forms of the present disclosure, the first and second platforms 110, 120 may be directly connected to the flexible member 181.

In FIG. 5A, the connection of the first attachment bracket 186 with the first platform 110 may be offset forward of the midpoint 115 of the first platform 110 to enable the flexible member 181 letting the first and second platforms 110 travel past the first and second rotational axis 182, 184 (See FIG. 3B for the second attachment bracket 188 of the second platform 120). This configuration of the attachment brackets 186, 188 may be configured for allowing the rearmost position of the first or second platform 110, 120 to move further rearward than a cutout 102 (see FIGS. 3A and 9A) located at the middle location of the base 140. Accordingly, the midpoints 115, 125 of the first and second platforms 110, 120 may be configured to move between the first and second rotational axis 182, 184 and beyond the second rotational axis 184. However, other suitable arrangement of the attachment brackets with the first and second platform 110, 120 may be implemented.

The first rotational axis 182 is operatively engaged with the disc 172 of the resistance mechanism 170. In accordance with an exemplary form of the present disclosure, the first rotational axis 182 may be coaxially connected with the disc 172 and the second rotational axis 184 is rearwardly located at a certain distance from the first rotational axis 182 on the same plane as the first rotational axis 182. Furthermore, the disc 172 may be placed on a plane parallel to a plane 166 (see FIG. 2) of the base 140. When the exercise device 100 may be placed on the floor without adjusting any angle by the front or rear kick stand 146, 148 (see FIG. 2), the plane of the disc 172, the plane 166 of the base 140, the plane 112, 122 of the first or second platform 110, 120, and the floor are all parallel each other. Accordingly, the disc 172 can be rotated relative to a vertical axis Z of the plane 166 of the base 140 (see also FIG. 2).

FIGS. 6A-6E illustrates another resistance mechanism (called as a second resistance mechanism 270) for resisting the movement of the first platform 110 and the second platform 120 in the coupling mechanism 180. The same parts as in the coupling mechanism 180 are identified with the same reference numerals, and explanation thereof is omitted. The second resistance mechanism 270 may use two discs for resisting the movement of the first and second platform 110, 120 instead of using one disc 172 in FIG. 3A-3D. According to this structure, a first disc 271 may be positioned in front side of the base 140 and a second disc 272 may be positioned in rear side of the base 140. The second disc 272 may be located rearwardly in a certain distance from the first disc 271. Accordingly, the first disc 271 may be in a forward position and the second disc 272 may be in a rearward position along a longitudinal axis X of the base. However, other suitable arrangement of the discs may be implemented according to other forms of the present disclosure.

Figure 3A:
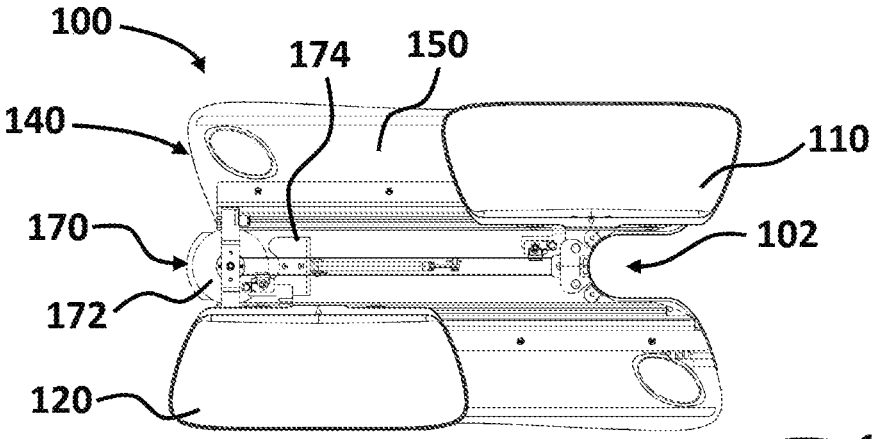
FIG. 3A is a perspective view of foot platforms at end stops.
Figure 3B:
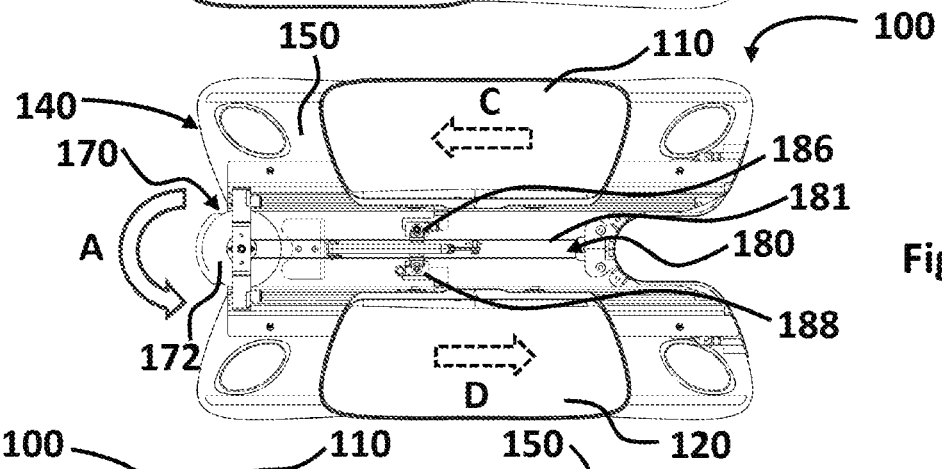
FIG. 3B is a perspective view of foot platforms moving in first direction causing resistance disc to rotate CCW direction.
Figure 3C:
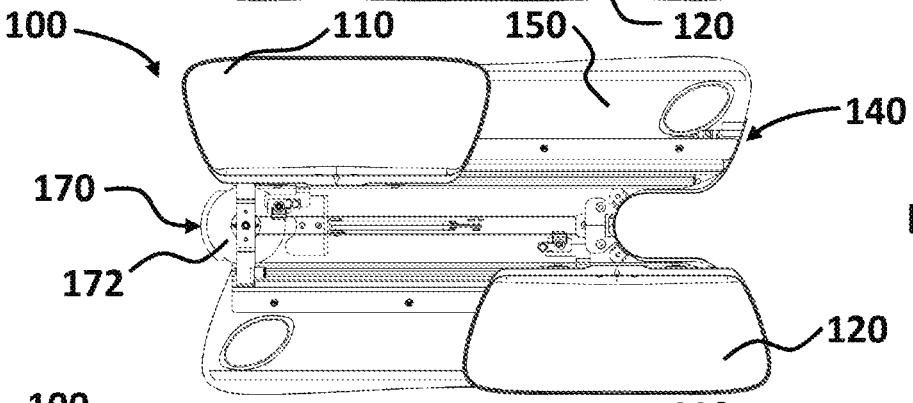
FIG. 3C is a perspective view of foot platforms at end stops.
Figure 3D:
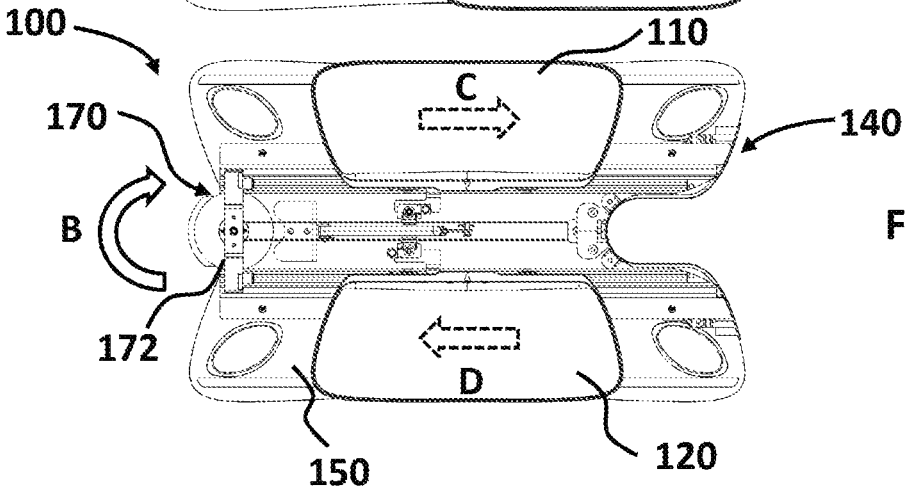
FIG. 3D is a perspective view of foot platforms moving in second direction causing resistance disc to rotate CW direction.
Figure 6A:
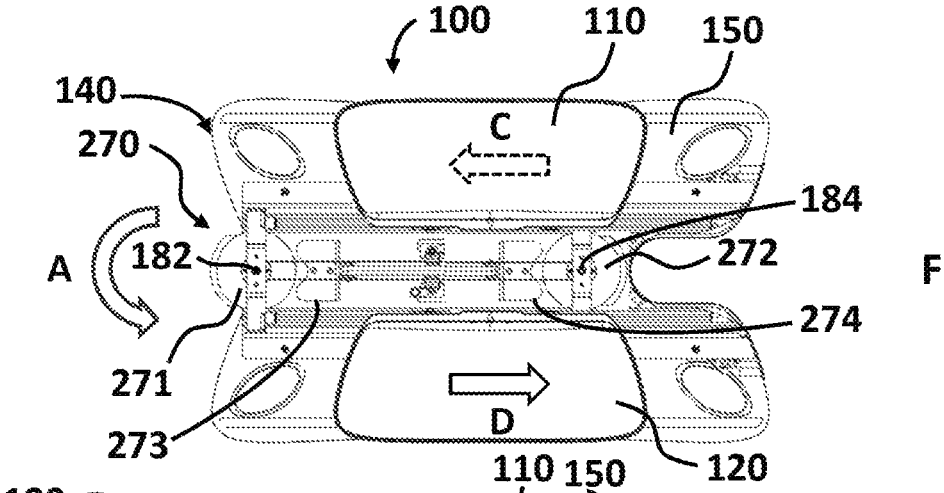
FIG. 6A is a perspective view of foot platforms moving in first direction causing a first resistance disc to rotate in the CCW direction.
Figure 6B:
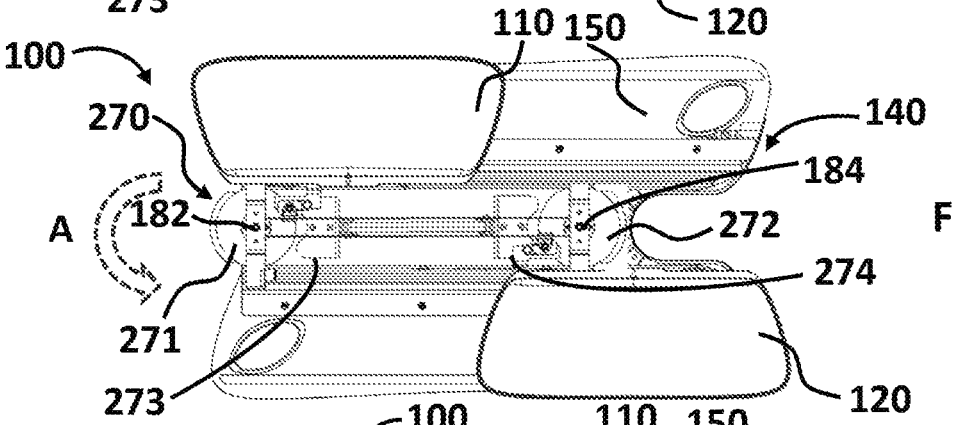
FIG. 6B is a perspective view of foot platforms at end stops while the first disc keeps rotating.

As shown in FIGS. 3A-3B, the one disc 172 may be placed in front side of the base 140 and configured for rotating reciprocally in both directions A (CCW) and B (CW). In contrast with the one disc resistance mechanism 170, the second resistance mechanism 270 has two discs and each disc 271, 272 may be configured for rotating in its own opposing rotational direction relative to the vertical axis Z of the base 140. For example, the front disc 271 may start rotating in the first rotational direction A (CCW) as the first platform 110 moves from the rearward position to the forward position as shown in FIG. 6A, and the second disc 272 may start rotating in the second rotational direction B (CW) as the first platform 110 moves from the forward position to the rearward position as shown in FIG. 6C.

Figure 6C:
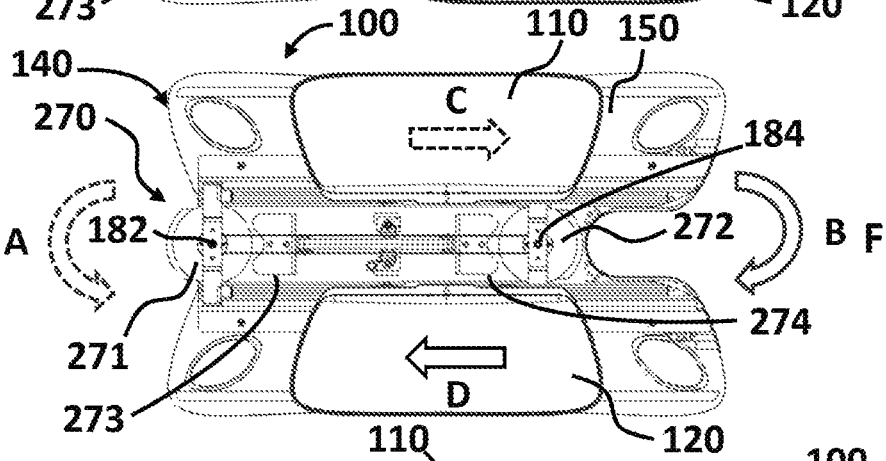
FIG. 6C is a perspective view of foot platforms moving in second direction causing a second resistance disc to rotate in the CW direction while the first disc keeps rotating.
Figure 6D:
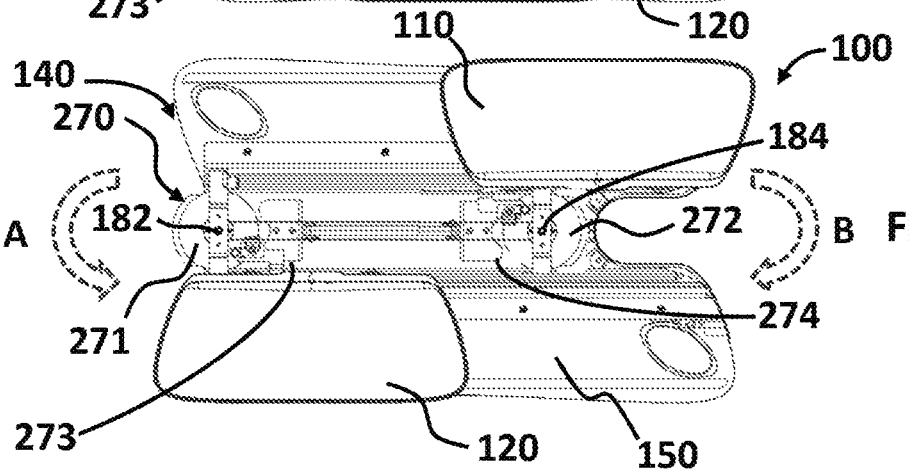
FIG. 6D is a perspective view of foot platforms at end stops while the first and second disc keep rotating, and 6E is an exploded view of second resistance mechanism.
Figure 6E:
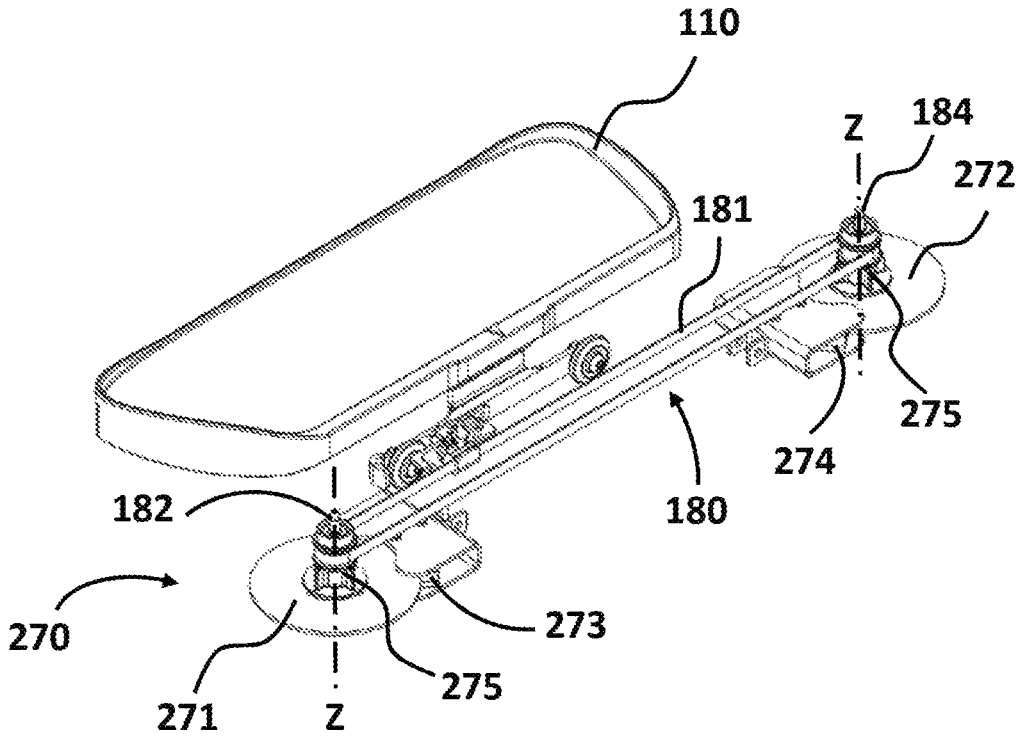

In addition, as shown in FIGS. 6B-6E, each disc 271, 272 in the second resistance mechanism 270 continues to rotate in its own direction for providing a flywheel type boost to the movement of the first and second platform 110, 120. For example, the first disc 271 keeps rotating in its own direction A (CCVV) even though the first platform 110 moves from forward position to rearward position as shown in FIG. 6C, and the second disc 272 also keep rotating in its own direction B (CW) as shown in FIG. 6D because a one-way clutch system 275 may be respectively connected with the first and second discs 271, 272 (see FIG. 6E). In addition, the one-way clutch systems 275 are operatively coupled with the flexible member 181 of the coupling mechanism 180. Accordingly, the one-way clutch systems 275 may be configured for allowing each disc 271, 272 to be linked only with the flexible member 181 when the flexible member 181 is moving in the same direction as each disc's rotational direction as described above.

As shown in FIGS. 6A-6E, the first disc 271 may be coaxially attached with the first rotational axis 182 and the second disc 272 may be coaxially attached with the second rotational axis 184. According to this structure, the second resistance mechanism 270 may also adjust the resistance movement of the first platform 110 and the second platform 120 by engagement area between each disc 271, 272 and a first and second magnets 273, 274. As shown in FIGS. 6A-6E, the first disc 271 may be engaged with the first magnets 273, and the second disc 272 may be engaged with the second magnets 274. In addition, the engaged area between each disc 271, 272 and each magnets 273, 274 may be controlled by the adjuster 178 (see FIG. 4A) operatively coupled with the first and second magnets 273, 274. However, other suitable arrangements of the adjuster 178 may be implemented in other forms of the present disclosure.

Figure 7A:
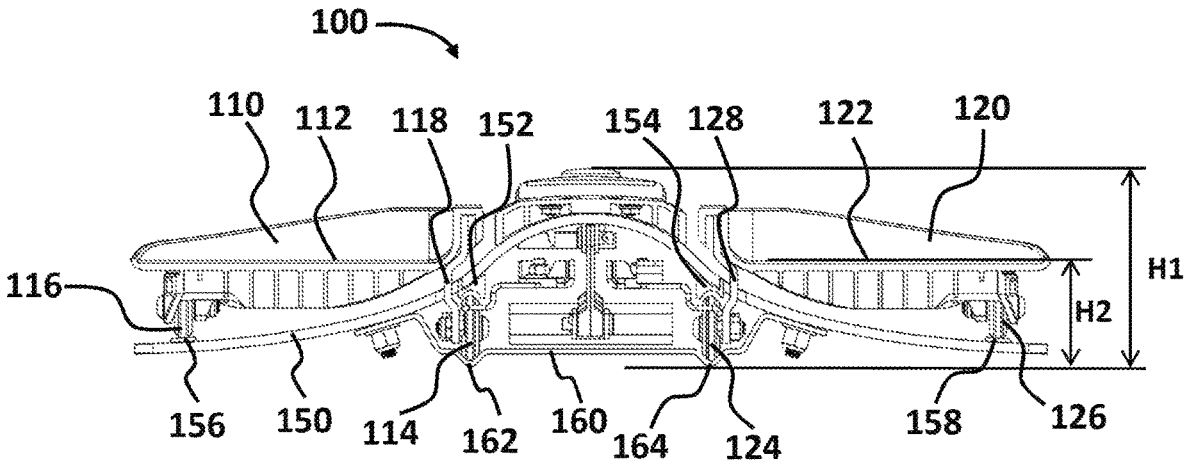
FIG. 7A is a front cross-section view of the exercise device.
Figure 7B:
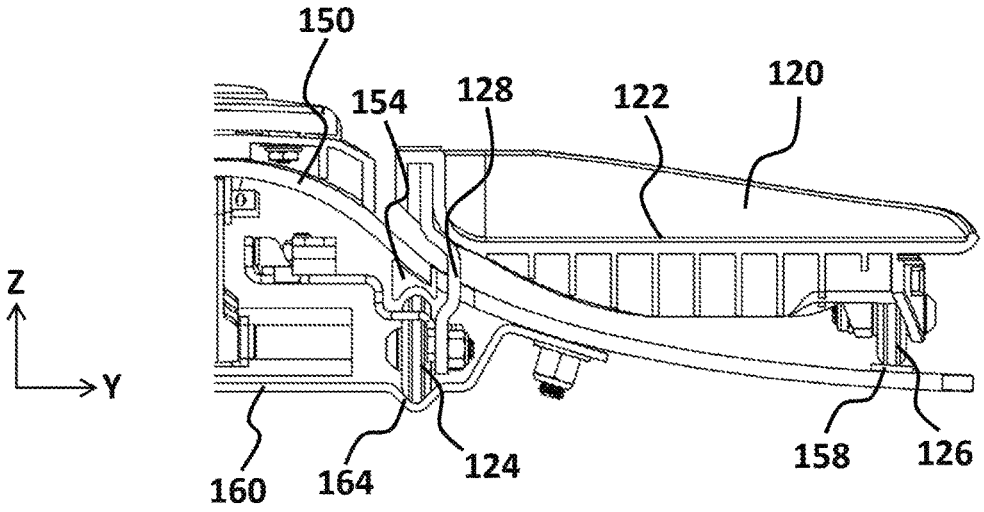
FIG. 7B is a detail view of a second platform side corresponding to FIG. 7A.

FIGS. 7A-7B show a front cross-section view of the exercise device 100. FIG. 7A shows the inner upper and lower rails 152, 154, 162, 164 and outer rails 156, 158 configuration. Generally, in a configuration of the exercise device 100, a narrow and low profile height H1 of the exercise device 100 is critical for proper operation with numerous chairs. In accordance with an exemplary form of the present disclosure, the height H1 from the floor to the top surface of the exercise device 100 may be less than 2.5 inch, and a height H2 from the floor to the plane 112, 122 of the first or second platform 110, 120 may be less than 1.5 inch. Those heights H1, H2 provide optimal user positioning e.g., the user's feet may be low to the floor, and their upper leg is approximately parallel with the floor (hip angles less than or equal to 90 degrees). Accordingly, the exercise device's 100 low height dimension enable the user to place the exercise device 100 under his/her desk, and still maintain proper clearance between the user's leg and the underside of the desk.

FIG. 7B shows only the second platform 120 side of the exercise device 100 for illustrating the rail engagement with roller wheels in detail because the first platform 110 side and the second platform 120 side are symmetric, and they have same configuration. Accordingly, the detail description of the first platform 110 side regarding the engagement of the roller wheels and the rails will be skipped. In accordance with an exemplary form of the present disclosure, as shown in FIGS. 7A-7B, the upper panel 150 includes the first and second inner upper rail 152, 154 and the first and second outer rail 156, 158, and the lower panel 160 includes the first and second inner lower rail 162, 164. However, other suitable configuration of the rails in other forms of the present disclosure may be implemented.

As shown in FIG. 7B, each of the second inner upper and lower rails 154, 164 defines a C-shape where the second inner roller wheels 124 are engaged. The C-shape rails can be used as guides for the inner roller wheels 124. The outer rail 158 also defines a flat shape where the second outer roller wheels 126 are engaged. However, other suitable shapes of the inner upper and lower rails 154, 164 and the outer rail 158 may be implemented in other forms of the present disclosure. The second inner roller wheels 124 are mounted under the second platform 120 by a second wheel attachment bracket 128, and are configured for pairing with the inner rails 154, 164. The second outer roller wheels 126 are also operatively mounted under the second platform 120 for pairing with the outer rail 158. In particular, the second inner upper and lower rails 154, 164 are configured to prevent lateral movement of the second platform 120. The inner and outer roller wheels 124, 126 may have a soft urethane or other materials that minimize noise between the roller wheels 124, 126 and the rails 154, 164, 158 for smooth and quiet operation.

Figure 8:
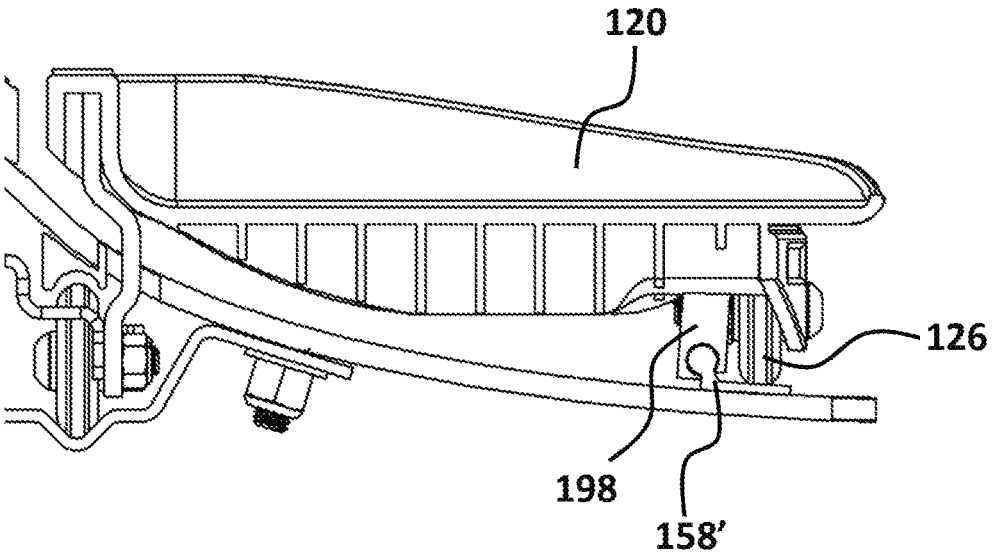
FIG. 8 is a detail view of a second platform side with alternative outer rail with a secondary linear glide.

FIG. 8 shows an alternative outer rail 158' configuration of the second platform 120 side. The alternate outer rail 158' may be operatively coupled with a secondary linear glide 198. The secondary linear glide 198 may be operatively attached to the second platform 120 as shown in FIG. 8. Accordingly, the second linear glide 198 can move along the movement of the second platform 120, and the engagement between the secondary linear glide 198 and the alternate outer rail 158' prevents the outer roller wheels 126 of the second platform 120 from lifting off the alternate outer rail 158'.

Figure 9A:
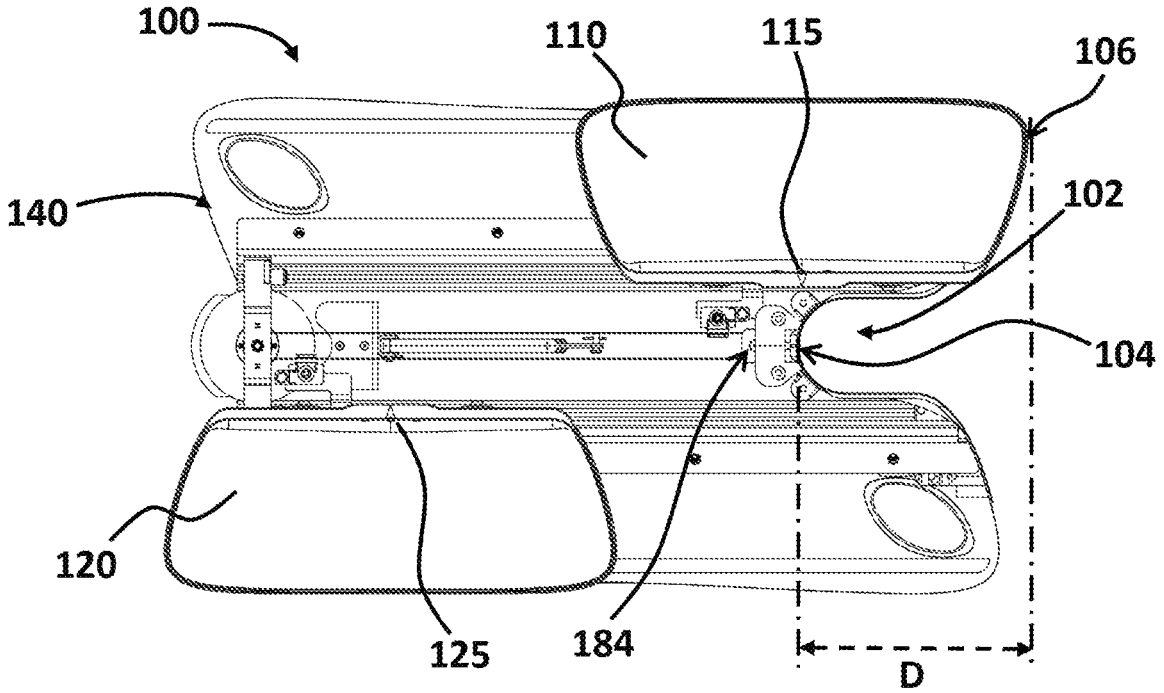
FIG. 9A is a top view of the exercise device with a cutout.
Figure 9B:
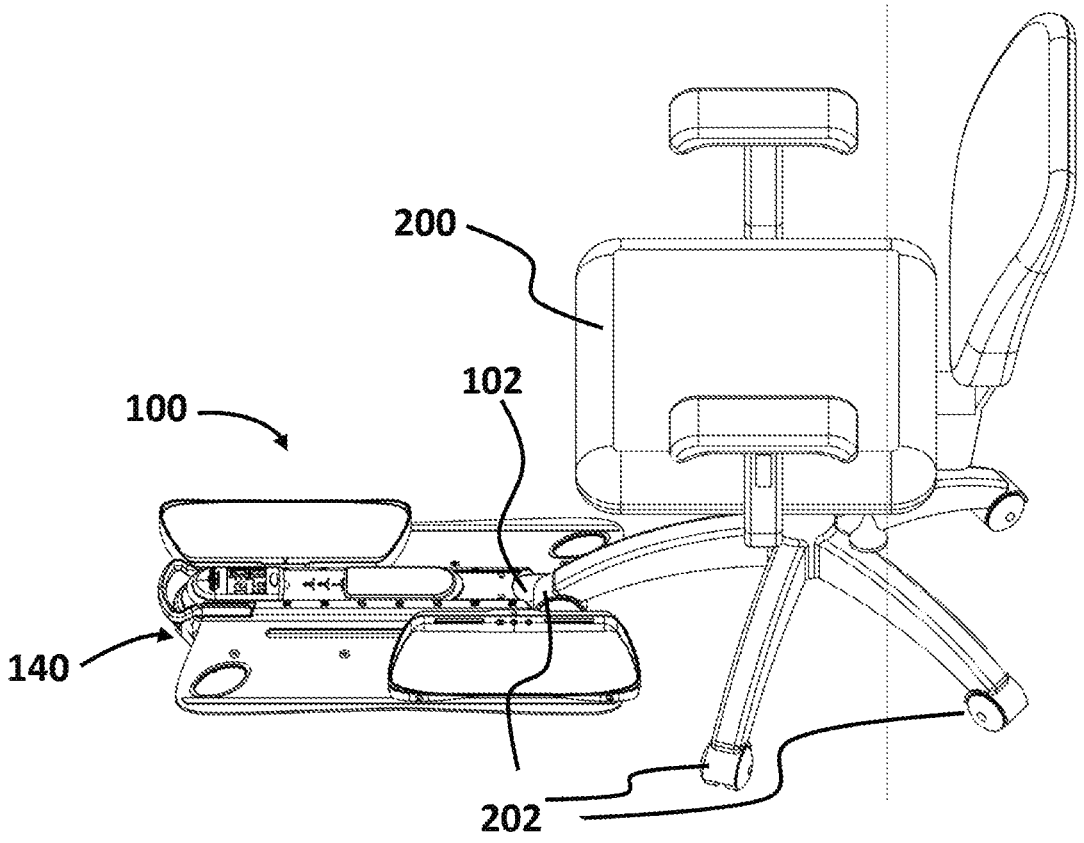
FIG. 9B is a perspective view of the exercise device with the cutout for caster receptacle.

FIG. 9A shows a top view of the exercise device 100. For providing the user's position properly in his/her seated position, the exercise device 100 includes the cutout 102 at center location in rear end of the base 140. An end 104 of the cutout 102 is forwardly located in a certain distance D from a rearmost position 106 of the first or second platform 110, 120. For example, as shown in FIG. 9A, when the first platform is moved to the rearmost position 106, the distance D is measured from the rearmost position 106 of the first platform 110 to the end 104 of the cutout 102. In addition, in the rearmost position 106 of the first platform 110, the middle point 115 of the first platform 110 may be located rearwardly beyond the second rotational axis 184. The location of the middle point 115 of the first platform 110 relative to the second rotational axis 184 may be configured for allowing the rearmost position of the user's heel to go further rearward than the cutout 102.

In accordance with an exemplary form of the present disclosure, the cutout 102 is configured for receiving a caster 202 of the chair 200 to get the user into the optimal position for exercising or rehabilitating the user's lower body as shown in FIG. 1B. In other forms of the present disclosure, the cutout 102 is also configured to receive any leg type of chairs. The cutout 102 of the exercise device 100 can secure the chair 200 by placing one of the casters 202 inside the cutout 102 when the user is in a seated position. In further, the cutout 102 of the base 140 may be configured to prevent the casters 202 of the chair 200 from interfering with the exercise device 100.

Figure 10:
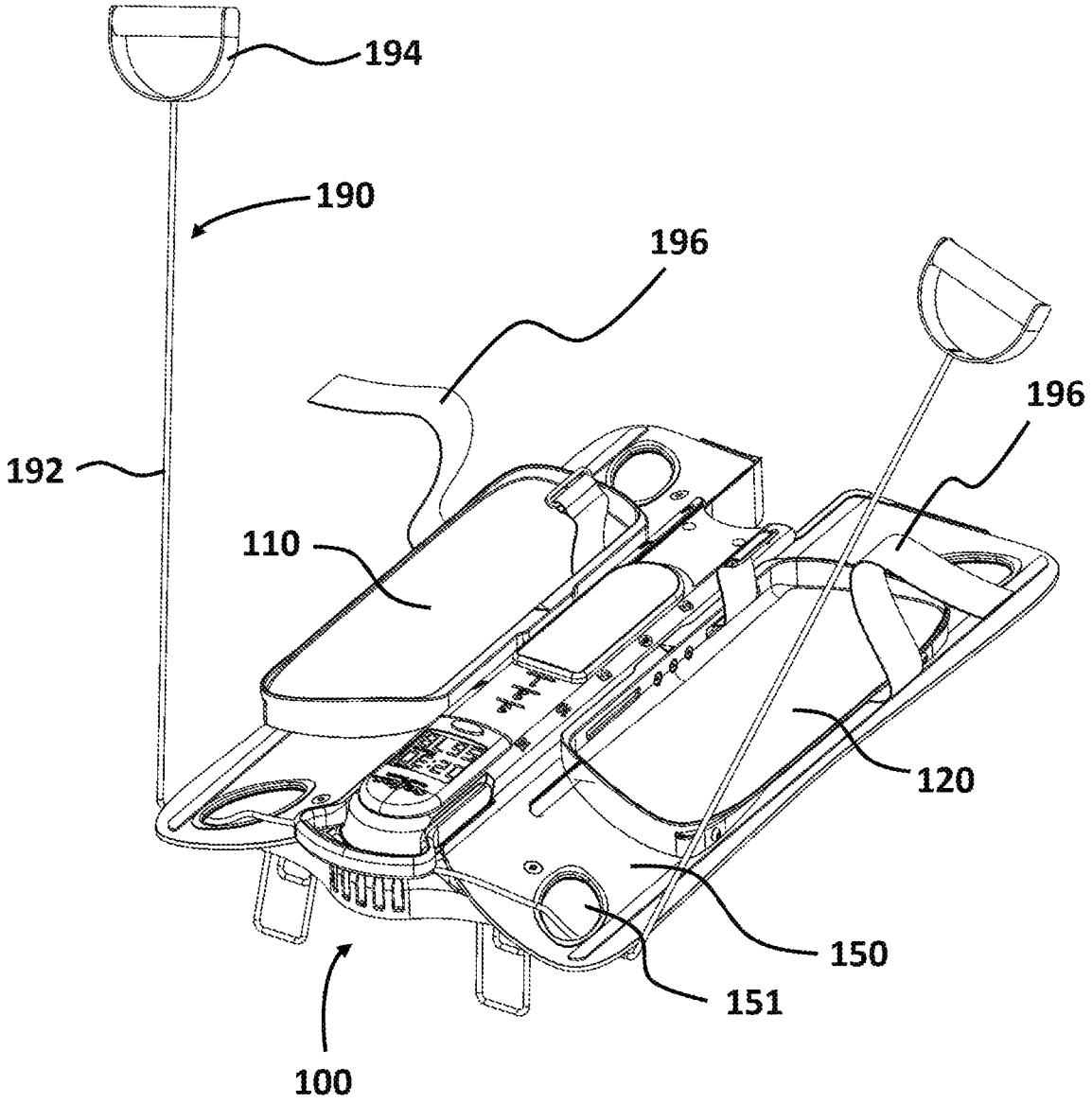
FIG. 10 is a perspective view of the exercise device with resistance band and foot straps.

In FIG. 10, the exercise devices 100 comprises foot straps 196. The foot straps 196 may be easily installed or removed from the first and second platform 110, 120 and is configured for securing the user's foot to the first and second platform 110, 120. Furthermore, more than a foot strap 196 such as a toe strap and a heel strap may be installed into each of the first and second platforms. Each strap 196 (toe or heel strap) may be configured to secure the specific area (toe or heel, etc.) of the user's foot. While exercising or rehabilitating in the seated position, the user's foot can be securely placed on the first and second platform 110, 120 by using the foot straps 196.

As shown in FIG. 10, the exercise device 100 further comprises a resistance band 190 for exercising an upper body of the user. The resistance band 190 can be quickly coupled with the exercise device 100 for enabling a total body workout. The resistance band 190 generally includes grip handles 194 and a cord 192 that has an elastic characteristic. In addition, the resistance band 190 is commonly used for strength training, physical therapy, and specifically muscular injuries.

Furthermore, the resistance band 190 may be easily coupled with the exercise device 100 by passing through a couple of oval holes 151 of the upper panel 150. The cord 192 of the resistance band 190 may pass through two oval holes 151 in front of the upper panel 150 for coupling with the exercise device 100. Accordingly, the user may exercise his/her upper body while the user are exercising his/her lower body.

The foregoing description of various forms of the invention has been presented for purposes of illustration and description. It is not intended to be exhaustive or to limit the invention to the precise forms disclosed. Numerous modifications or variations are possible in light of the above teachings. The forms discussed were chosen and described to provide the best illustration of the principles of the invention and its practical application to thereby enable one of ordinary skill in the art to utilize the invention in various forms and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. An exercise device comprising:

a base;

a first platform configured to move between a forward position and a rearward position along a first path relative to the base;

a second platform configured to move between the forward position and the rearward position along a second path relative to the base;

a flexible member operatively coupled with the first platform and the second platform; and a resistance mechanism coupled with the flexible member and configured to resist the movement of at least one of the first platform or the second platform;

wherein the resistance mechanism includes a disc and is configured to allow the disc to rotate relative to the base in a first direction as the first platform moves from the rearward position to the forward position and a second direction opposite the first direction as the first platform moves from the forward position to the rearward position, wherein the flexible member is configured to allow the disc to rotate reciprocally in response to the movement to the first platform or the second platform, wherein the resistance mechanism further includes a magnet configured to resist the movement of the first platform or the second platform by a magnetic resistance force between the disc and the magnet, and an adjuster coupled with the magnet and configured to move generally parallel to the first path for providing variable resistance to the movement of the first platform or the second platform.

2. The exercise device of claim 1, wherein the adjuster is substantially placed between the first platform and the second platform, and configured to move in a longitudinal direction relative to the base.

3. The exercise device of claim 1, wherein the adjuster is configured to adjust an engagement area between the disc and the magnet.

4. The exercise device of claim 1, wherein the first path and the second path comprise a generally linear path.

5. The exercise device of claim 1, wherein the base includes an upper panel and a lower panel, and wherein the upper panel includes a first outer rail, a second outer rail, a first inner upper rail and a second inner upper rail, and the lower panel includes a first inner lower rail and a second inner lower rail.

6. The exercise device of claim 5, wherein inner and outer roller wheels are mounted under the first platform and the second platform, and are configured for pairing with the inner upper and lower rails and the outer rails.

7. The exercise device of claim 1, wherein the flexible member includes an elastic timing belt, and the flexible member is configured to maintain a tension.

8. The exercise device of claim 1, wherein the first platform and the second platform are respectively connected with the flexible member by a first and a second attachment bracket.

9. The exercise device of claim 1, wherein the flexible member is configured to move about a first rotational axis and a second rotational axis to couple with the movement of the first platform and the second platform, wherein the first rotational axis is coaxially connected with the disc and the second rotational axis is rearwardly located from the first rotational axis, and wherein the first and second rotational axes are substantially positioned between the first platform and the second platform.

10. The exercise device of claim 1, wherein the base comprises a cutout at a rear end of the base, and an end of the cutout is forwardly located from a rearmost position of the first platform or the second platform.

* * * * *